United States Patent [19]

Klavir

[11] 4,130,463

[45] Dec. 19, 1978

[54] DUCT SWIVEL JOINT

[75] Inventor: Samuel N. Klavir, Bellmore, N.Y.

[73] Assignee: Envirotech Corporation, Menlo Park, Calif.

[21] Appl. No.: 823,256

[22] Filed: Aug. 10, 1977

[51] Int. Cl.[2] ..... C10B 27/06; C10B 33/00; F16L 27/12

[52] U.S. Cl. ..... 202/263; 105/254; 141/311 R; 285/9 R; 285/70; 285/184

[58] Field of Search ..... 202/263, 254; 285/9 R, 285/65, 70, 184; 105/223, 8 R, 10, 14, 21, 238 R; 141/311, 382, 387, 388; 105/254

[56] References Cited

U.S. PATENT DOCUMENTS

| | | | |
|---|---|---|---|
| 1,019,777 | 3/1912 | Fowler | 105/14 |
| 2,124,474 | 7/1938 | Scholtes | 285/184 X |
| 3,634,904 | 1/1972 | Larsen | 285/9 R X |
| 3,843,461 | 10/1974 | Allen | 202/263 X |

FOREIGN PATENT DOCUMENTS

| | | | |
|---|---|---|---|
| 974003 | 2/1951 | France | 285/184 |

*Primary Examiner*—Morris O. Wolk
*Assistant Examiner*—Arnold Turk
*Attorney, Agent, or Firm*—William S. Bernheim; Robert E. Krebs

[57] ABSTRACT

Apparatus for connecting two otherwise coupled railroad vehicles in gaseous flow communication comprises first and second ducts each mounted respectively at one end to one of the railroad vehicles, first and second coupling ducts each mounted respectively at an opposite open end of the first and second ducts to pivot about a vertical axis with one end enclosed in its respective duct and with a second end extending out from its respective duct, first and second frame members each mounted respectively at the second end of the first and second duct and having a mating surface circumferentially surrounding the second end, and first and second biasing means to extend between the respective pair of duct and coupling duct to urge the second end away from its duct and maintain the respective mating surfaces in abutting and sliding engagement one with the other.

2 Claims, 3 Drawing Figures

DUCT SWIVEL JOINT

BACKGROUND OF THE INVENTION

1. Field of Invention

The present invention generally relates to a system for connecting two vehicles in gaseous flow communication when the vehicles are otherwise mechanically coupled together.

2. State of the Art

U.S. Pat. No. 3,869,352, discloses a system to reduce the release of polluting emissions when coke is discharged or "pushed" from coking ovens. The system according to that patent comprises two railroad vehicles which are mechanically coupled together. The first vehicle, which is a hooded car, is adapted to directly receive a "push" of coke from a coking oven. The second vehicle, which contains gas cleaning equipment, is connected by a duct to receive gaseous emissions from the coke in the first vehicle.

In a two-vehicle system such as the one described in the aforementioned patent, the duct through which the gaseous emissions are conveyed between the vehicles is a vital element. The duct must be able to withstand severe, though limited bending as a result of the motion of the vehicles relative to one another. Further the duct must be able to withstand, without leakage, the high temperature and abrasive character of the emissions carried through it.

In prior two-vehicle systems, it is known to provide a rigid, continuous duct which is pivotably mounted to one of the vehicles. For example, it is known to provide a rigid duct whose one end is rigidly fixed to the first railroad vehicle and whose other end is pivotably fixed to the second vehicle in a manner similar to a ball and socket joint. Such a joint, however, is difficult to seal so as to prevent leakage of gaseous emissions.

OBJECT OF THE INVENTION

The primary object of the present invention is to provide an improved system whereby two independent vehicles are connected together in gaseous flow communication.

BRIEF DESCRIPTION OF THE DRAWINGS

Further objects and advantages of the present invention may be readily ascertained by reference to the following description and appended drawings which are offered by way of description only and not in limitation of the invention, the scope of which is defined by the appended claims and equivalents.

In the Drawings.

DETAILED DESCRIPTION OF THE PREFERRED EMBODIMENT OF THE INVENTION

Figure 1:
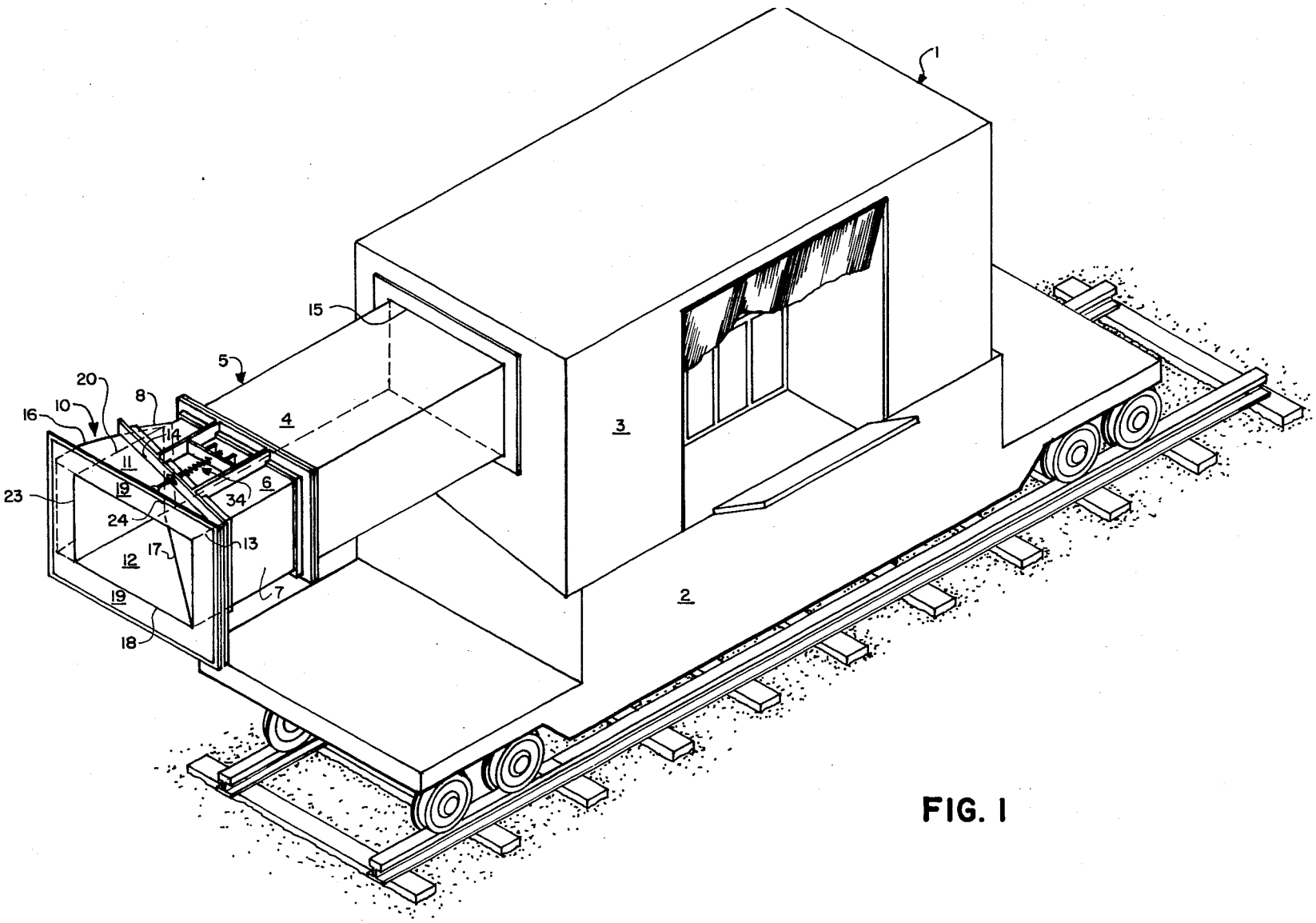
FIG. 1 is a perspective view of a railroad vehicle, shown schematically, according to the present invention.

Referring to FIG. 1, a first railroad vehicle 1 for receiving coke from a coke oven includes a body 2 into which coke is received and a hood 3 mounted over the body 2 to capture emissions from the coke. Fixedly mounted at one end 15 in flow communication to the hood 3 and interior of the first vehicle 1 is a first member 4 of a connecting duct 5 to connect in gaseous flow communication the first vehicle 1 to a second railroad vehicle (not shown in the Figures). The connecting duct 5 provides a flow path when the two vehicles are otherwise mechanically coupled together by which emissions captured in the hood 3 of the first vehicle 1 can be drawn into the second vehicle.

The first member 4 includes a fixedly mounted first angled duct 6 having a first side panel 7 and an opposite side panel 8 which is shorter in length than the first side panel 7 and has an arcuate portion. The first member 4 also includes a first coupling duct 10 having sector-shaped top and bottom walls 11 and 12. The coupling duct 10 is moveably mounted to the angled duct 6 and distally from the first vehicle 1 to pivot about a generally vertical axis adjacent and parallel to the side edge 13 of the first side panel 7 at an open end 14 of the angled duct 6 spaced from the end 15 at which the first member 4 is fixedly mounted to the first vehicle 1. The apexs of the sector-shaped top and bottom walls 11 and 12 of the coupling duct 10 are adjacent the vertical axis of pivot and the curved edges of the top and bottom walls 11 and 12 are joined by an arcuate side panel 16.

Figure 2:
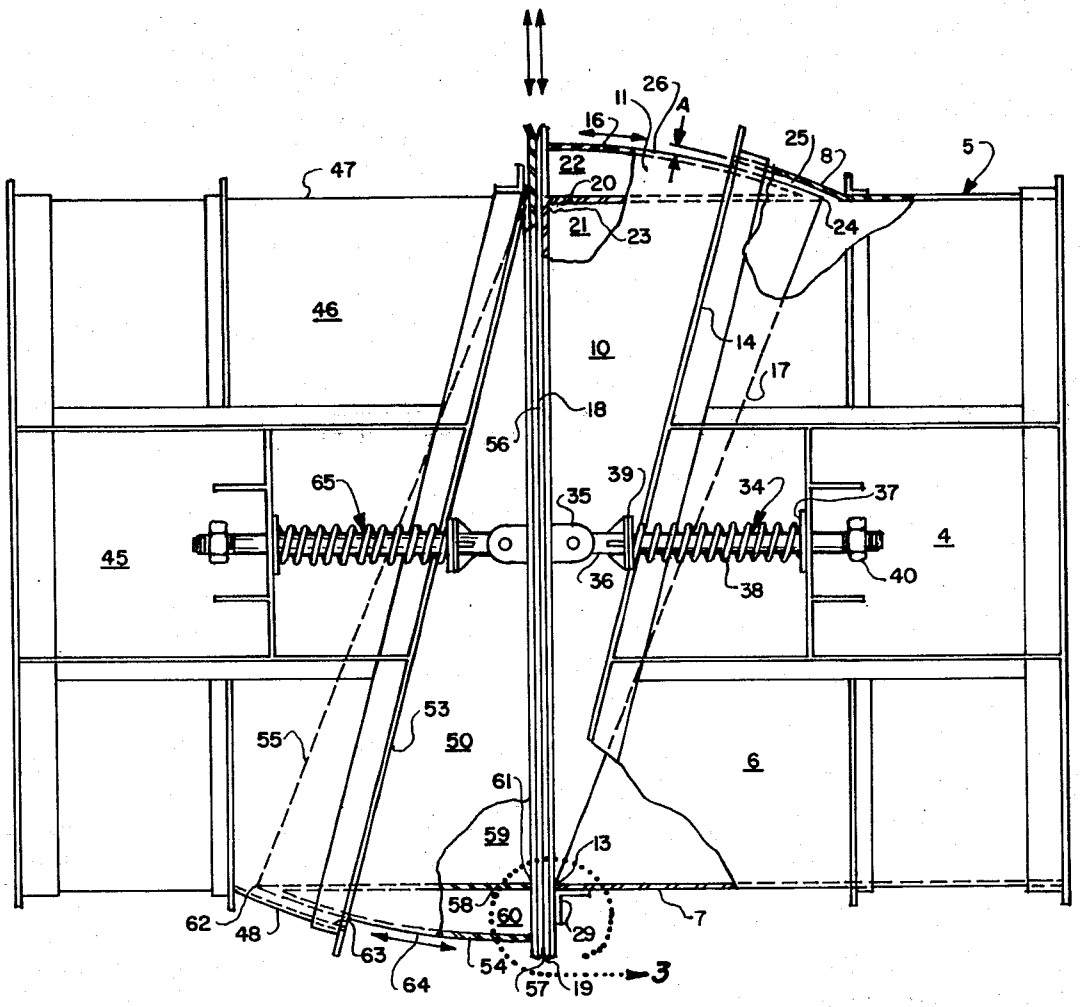
FIG. 2 is a top view of two connecting ducts according to the present invention.

As shown in FIGS. 1 and 2, the coupling duct 10 has a first open end 17 which is enclosed by the fixed portion of the member 4 and an opposite second open end 18 which defines an aperture and extends out from the open end 14 of the angled duct 6 and towards the second vehicle. The second open end 18 includes a frame member 19 having a flat mating surface circumferentially surrounding the aperture. The pivoting of the coupling duct 10 lengthens or shortens the effective length of the one side of the first member 4.

Preferably, a partition wall 20 is mounted within the first coupling duct 10 to divide the space enclosed by that duct 10 into a flow path 21 and a dead space 22, through which no gas flows. The wall 20 extends between the top and bottom walls 11 and 12 and between the inside side edge 23 of the frame member 19 adjacent the cylindrical side panel 16 and the vertical edge 24 of the cylindrical side panel 16 at the first open end 17 of the coupling duct 10.

The inside surface 25 of the arcuate portion of the side panel 8 of the first angled duct 6 and the outside surface 26 of the arcuate panel 16 of the coupling duct 10 are concentric and narrowly spaced apart. The narrow space between the concentric panels allows sufficient clearance "A" for the surfaces 25 and 26 to pass by each other as the coupling duct 10 is pivoted and minimize the escape of emissions between the surfaces 25 and 26.

Figure 3:
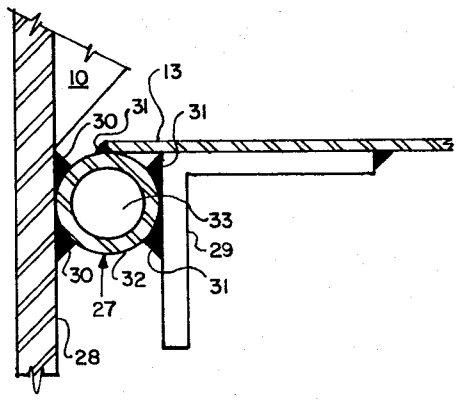
FIG. 3 is an enlargement, partially cutaway view of a detail enclosed by arrow 3 in FIG. 2.

A hinge means 27, as shown in FIG. 3, provides means to pivotably mount the first coupling duct 10 to the angled duct 6. A first hinge plate 28 is mounted to the first coupling duct 10 and a second hinge plate 29 is mounted to the angled duct 6. The two hinge plates have respective sockets 30 and 31 which are aligned to form a hinge-type cylinder 32 into which a pivot pin 33 is inserted and about which the coupling duct 10 is pivoted.

A first biasing means 34 is mounted on the top side of the first member 4 to connect between the fixed portion of the first member 4 and the first coupling duct 10 to urge the second open end 18 of the coupling duct 10 to pivot outward from the open end 14 of the angled duct 6. Suitable first biasing means 34, as shown in FIGS. 1 and 2, includes a bracket 35 fixedly mounted to the frame member 19 and a rod 36 pivotably mounted in the bracket 35 and extending back towards the angled duct 6. The rod 36 extends slideably through a fitting 37, such as a cup washer, mounted on the angled duct 6. Extending in compression about the rod is a spring 38 connected at one end to the rod 36 by a spring stop 39 and compressed at its other end against the fitting 37. To limit the outward movement of the second open end 18 from the angled duct 6, a stop nut 40 is mounted on the opposite end of the rod 36 from the bracket 35. Means, such as shims, can be inserted between the spring 38 and spring stop 39 to adjust the effective length of the spring. To prevent jamming, a similar first biasing means is mounted on the bottom side of the first member 4.

To complete the connecting duct 5, a second member 45 (FIG. 2) is fixedly mounted at one end in flow communication with the interior of the second spaced apart railroad vehicle. The second member 45 is similar in configuration to the first member 4.

The second member 45 includes a second angled duct 46 having a first side panel 47 and an opposite side panel 48 which is shorter in length and has an arcuate portion. The second member 45 also includes a second coupling duct 50 having sector-shaped top and bottom walls.

The coupling duct 50 is moveably mounted to the second angled duct 46 and distally from the second vehicle to pivot about a generally vertical axis adjacent and parallel to the side edge of the first side panel 47 at an open end 53 of the angled duct 46 spaced from the end at which the second member 45 is fixedly mounted to the second vehicle. The apexs of the sector-shaped top and bottom walls of the second coupling duct 50 are adjacent the vertical axis of the pivot and the curved edges of the top and bottom walls are joined by an arcuate side panel 54. The inside surface 63 of the arcuate portion of the side panel 48 of the second angled duct 46 and the outside surface 64 of the arcuate panel 54 of the second coupling duct are concentric and narrowly spaced apart.

The second coupling duct 50 has a first open end 55 which is enclosed by the fixed portion of the second member 45 and an opposite second open end 56 which defines an aperture and extends out from the open end 53 of the second angled duct 46 and towards the first vehicle. The second open end 56 includes a frame member 57 having a flat mating surface circumferentially surrounding the aperture. The pivoting of the coupling duct 50 lengthens or shortens the effective length of one side of the second member 45.

As with the first coupling duct, a partition wall 58 is mounted within the second coupling duct 50, to divide the space enclosed by the second coupling duct 50 into a flow path 59 and a dead space 60. The wall 58 extends between the top and bottom walls of the coupling duct 50 and between the inside side edge 61 of the frame member 57 adjacent the cylindrical side panel 54 and the vertical edge 62 of the cylindrical side panel 54 at the first open end 55 of the second coupling duct 50.

Similarly, a second biasing means 65 is mounted on the top side of the second member 45 to connect between the fixed portion of the second member 45 and the second coupling duct 50 to urge the second open end 56 of the second coupling duct 50 to pivot outward from the open end 53 of the second angled duct 46 which direction is opposite that urged by the first biasing means 34. To prevent jamming, a similar second biasing means is mounted on the bottom side of the second member 45.

For the connecting duct 5 to provide gaseous flow communication between the vehicles, the first and second coupling ducts 10 and 50 are positioned on their respective vehicles such that when the vehicles are otherwise coupled, the coupling ducts 10 and 50 are in parallel alignment with the mating surface of their respective frame members 19 and 57 in abutting and sliding face-to-face engagement to form a sealing contact circumferentially about a flow path within the connecting duct 5. The engagement of the mating surfaces joins the apertures of the respective frame members 19 and 57. The vertical axis on which the respective coupling ducts 10 and 50 pivot are positioned on opposite sides of the connecting duct 5 so that pivoting of the coupling ducts 10 and 50 lengthens or shortens opposite sides of the connecting duct 5.

The first and second biasing means 34 and 65 are set in dynamic balance to press the mating surfaces of their respective frame members 19 and 57 one against the other so that on a straight stretch of track the respective frame members 19 and 57 are similarly urged outward and meet such that the first and second coupling ducts 10 and 50 are equally and only partially extended to form an unobstructed flow path in which the walls 20 and 58 serve as straight sidewalls for the connecting duct 5. When the vehicles are in motion, the mating surfaces can slide pass one another to maintain the seal by remaining in circumferential contact around the flow path although the flat surface adjacent the inside edges of the frame members 19 and 57 will somewhat obstruct the flow path. On shallow curves, one of the coupling ducts will retract while the other extends to continue to provide a connecting duct between the vehicles.

Of course the usefulness of the described connecting duct 5 is not limited to joining vehicles to handle coke emissions. The orientation of the axis on which the coupling duct pivots need not be vertical and can be horizontal in which orientation relative up-down motion of the vehicles caused by dips and bumps is compensated for.

I claim:

1. In a gas cleaning system including first and second vehicles mechanically coupled together in spaced-apart relationship, where the first vehicle is adapted to receive coke from a coking oven and the second vehicle contains gas cleaning equipment to clean fumes from coke received by the first vehicle, improved apparatus for effecting gaseous flow communication for the fumes between said vehicles comprising:

a. a first duct means including:

(i) a first open-ended, rigid duct member fixed at one of its ends in gaseous flow communication with the interior of the first vehicle; and (ii) a first rigid coupling duct having an inlet end and an outlet end; said coupling duct being pivotably mounted to said first duct member so that its inlet end is in sealed, gaseous flow communication with the opposite end of said first duct member; said first coupling duct having an arcuate wall and said first duct member having a complimentary arcuate wall at its said opposite end; said first coupling duct being mounted to pivot about a single, generally vertical axis so that said arcuate wall of said first coupling duct is pivotably movable side-by-side in an arc concentric with said arcuate wall of said first duct member;

b. first biasing means connected between said first duct member and said first coupling duct to urge said coupling duct to pivot about said vertical axis;

c. a first frame member fixed to circumferentially surround the outlet end of said first coupling duct to provide a first planar bearing surface perpendicular to said outlet end;

d. a second duct means including:

(i) a second open-ended, rigid duct member fixed at one of its ends in gaseous flow communication with the interior of the second vehicle; and (ii) a second rigid coupling duct having an inlet end and an outlet end; said coupling duct being pivotably mounted to said second duct member so that its inlet end is in sealed, gaseous flow communication with the opposite end of said second duct member; said second coupling having an arcuate wall and said second duct member having a complimentary arcuate wall at its said opposite end; said second coupling duct being mounted to pivot about a single, generally vertical axis so that said arcuate wall of said second coupling duct is pivotably movable side-by-side in an arc concentric with said arcuate wall of said second duct member;

e. second biasing means connected between said second duct member and said second coupling duct to urge said coupling duct to pivot about said vertical axis;

f. a second frame member fixed to circumferentially surround the outlet end of said second coupling duct to present a second planar bearing surface perpendicular to said outlet end of said second coupling duct; said first and second rigid duct members being located so that, when the first and second vehicles are coupled together, said first and second coupling ducts normally pivot in opposite directions so that said first and second frame members present mating faces which are in abutting and sliding engagement, one with the other, under the urging of said first and second biasing means to provide sealed gaseous flow communication between the first and second vehicles.

2. The improvement according to claim 1 wherein said first biasing means comprises:

a. a rod member pivotably connected at one of its ends to said first coupling duct and at its other end with said first rigid duct, and b. a spiral-wound spring member which surrounds said rod member to urge said coupling duct to pivot about the vertical axis.

* * * * *